United States Patent [19]

Lenhart et al.

[11] Patent Number: 4,519,609

[45] Date of Patent: May 28, 1985

[54] MODULAR RAKE SHAFT ASSEMBLY

[75] Inventors: Richard D. Lenhart, Arvada; Roger D. Lindblad, Westminster, both of Colo.

[73] Assignee: Zot Manufacturing Company, Arvada, Colo.

[21] Appl. No.: 570,640

[22] Filed: Jan. 13, 1984

[51] Int. Cl.[3] ..... A63D 5/08

[52] U.S. Cl. ..... 273/54 A

[58] Field of Search ..... 273/43 R, 43 A, 54 A

[56] References Cited

U.S. PATENT DOCUMENTS 4,210,242 7/1980 Mullen ..... 273/54 A X

FOREIGN PATENT DOCUMENTS 248526 12/1963 Australia ..... 273/54 A

*Primary Examiner*—Anton O. Oechsle

*Attorney, Agent, or Firm*—Fields, Lewis, Pittenger & Rost

[57] ABSTRACT

A modular rake shaft assembly is provided for attachment to and use the support frame of a bowling pin setting machine which includes three components namely, two rake arms interconnected by a tubular member. Each arm has a transversely extending stub shaft at one end. Each stub shaft has an opening on its outer end and a flange on its inner end. The tubular member has flanges at each end for connection to the respective stub shaft flanges. Each arm is tubular, but is deformed by a longitudinal groove along one side to increase the strength of the arms against bending. An angle member is also mounted on each arm to serve as a stop during movement of the arms and to further minimize the likelihood of breaking due to repeated striking of the arms against the stops. The flanges each have spaced lobes spaced unequally to accommodate swinging movement of the rake shaft assembly with respect to the support frame.

15 Claims, 10 Drawing Figures

Fig. 9
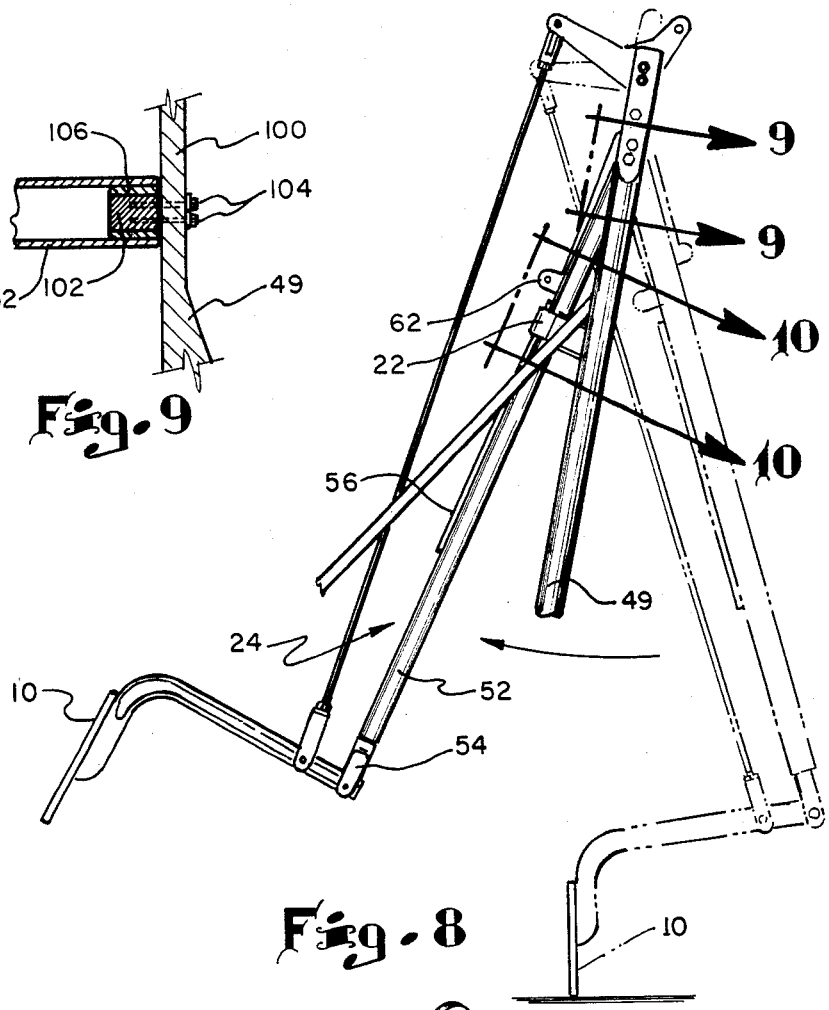
Fig. 8
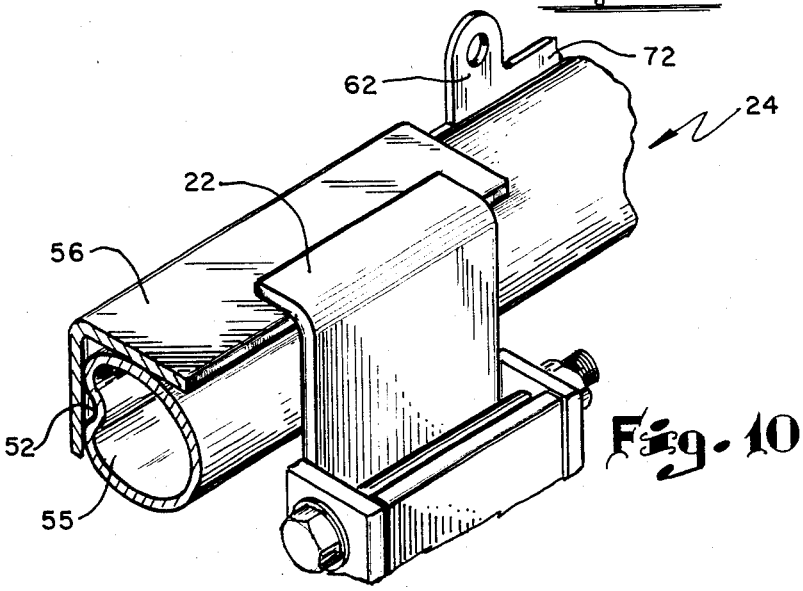
Fig. 10

MODULAR RAKE SHAFT ASSEMBLY

DESCRIPTION

1. Technical Field

This invention relates to a rake shaft assembly for an automatic bowling pin setting apparatus and more particularly to a modular rake shaft assembly which can be installed and/or replaced without the necessity of disassembling portions of the pin setting apparatus.

2. Background Art

In order to meet the needs of the bowling public, it has become necessary to devise bowling pin setting devices which can reset pins and return the bowling balls quickly and which are reliable in operation. Furthermore, the pin setting devices must be capable of rapid, inexpensive repair when they break down so as not to disrupt the bowling activity for a prolonged period of time.

Unfortunately, the bowling pin setting devices have become so complex that when a breakdown occurs, it is often necessary to disassemble significant portions of the machine in order to repair or replace the broken component. In particular, it is often necessary to disassemble the support structure for the turret assembly which arrange the pins prior to setting them. This results in extended down time and high labor costs.

An example of a component which is subject to relatively frequent failure, which can result in extended down time for the automatic pin setting apparatus, is the rake shaft assembly which pivots the rake to clear the pins from the alley after a bowling ball has been thrown. This component is typically made in one piece comprising a horizontal tubular member about which the component pivots and a pair of depending rake sweep arms on each side whose lower ends are connected indirectly to the rake. Typically, the arms swing against a pair of stops on the frame of the pin setting apparatus at the end of each cycle. As a result, the arms become fatigued after a period of use and break. In order to replace the rake shaft assembly, it is necessary to dismantle substantial portions of the pin setting machine. In particular, the turret support rods and the turret which holds the bowling pins must be disassembled. Furthermore, if the replacement rake shaft assembly is not exactly the same length as the one it replaces, the adjustments required in order to make it fit and work properly are considerable. The cost of replacement is not only the cost of the rake shaft assembly itself, but the considerable labor involved in removing the broken component and installing the new one. Furthermore, the rake shaft assembly is a relatively large component which is difficult to ship, requiring a large carton and is expensive to ship.

In order to avoid these costly repairs, the broken arms are repaired by welding. However, the metal in the arms is fatigued and new breaks occur at successively lower points along the arm after each weld. Eventually a new rake shaft assembly is required.

DISCLOSURE OF THE INVENTION

In accordance with this invention, a modular rake shaft assembly for pivotal attachment to the frame of an automatic bowling pin setting apparatus is provided. The assembly includes three components, namely a pair of spaced parallel elongated rake sweep arms and an interconnecting pivot shaft. Each arm has a first and second end, with a yoke at the first end of each arm for pivotal attachment to a rake board. A transverse stub shaft is mounted on the second end of each arm along an axis transverse to the axis of the arms, the stub shafts each being rotationally supported on the frame of the apparatus. A removable tubular section extends between the respective stub shafts and means are provided for removably connecting the tubular section to the stub shafts to facilitate disassembly.

More specifically, the rake shaft assembly includes a pair of parallel spaced elongated sweep arms wherein each arm includes a tubular member having a generally circular cross section with a score along one side thereof to deform one side to increase the strength of the member against bending. An angle member also can be provided along a portion of each arm to further strengthen each rake shaft arm against breakage due to striking a stop on the frame of the apparatus during each cycle of the apparatus. Additionally, each arm includes a U-shaped bracket at a first distal end of the arm for attachment to a rake board. A stub shaft is connected to and extends transversely across a second end of the arm and includes a bearing at the outer end of the stub shaft for pivoting the arm on the frame of the bowling pin setting apparatus about a transverse axis.

An inwardly facing flange is attached to the inner end of each stub shaft. A tubular section extends between the stub shafts and has first and second ends, each having a flange corresponding in size and shape to the inwardly facing flanges. Means, such as bolts, are provided for removably connecting the respective stub shaft flanges to the respective tubular member flanges to facilitate assembly and disassembly of the rake shaft assembly. The flanges of both the stub shaft and the tubular section may be provided with angularly disposed lobes with openings therethrough for receiving the bolts. With three lobes on each flange, the spacing between lobes can be on the order of 105 degrees which leaves the two lobes on the outer sides of a center lobe spaced at an angle of 150 degrees. This arrangement provides space to clear the cross rods to which support rods for the turret assembly is connected. Conveniently, connections are provided along each arm for connection to suitable drive means to pivot the arms.

With the rake shaft assembly described, it is possible to install and remove the same with virtually no disassembly of the automatic pin setting mechanism, which was previously impossible. Furthermore, the inner connecting flanges can be provided with shims to vary the length of the shaft to accommodate slight variations in the length of the shaft being replaced on different automatic pin setting devices.

An additional advantage of the rake arm assembly described is that it can be broken down into the three components for shipping. This results in a package of sufficiently small size which can be shipped in a smaller carton more economically than in the larger carton required by the prior art one piece construction.

Additional advantages of this invention will become apparent from the description which follows, taken in conjunction with the accompanying drawings.

BRIEF DESCRIPTION OF THE DRAWINGS

FIG. 8 is a fragmentary right side elevation showing a portion of the right sweep arm and how it engages a stop on the frame of the apparatus during each cycle;

FIG. 9 is an enlarged, substantially vertical section, taken along line 9—9 of FIG. 8, showing the pivot connection between the rake shaft assembly and the frame; and FIG. 10 is a greatly enlarged fragmentary perspective view of the stop and sweep arm construction taken along line 10—10 of FIG. 8.

BEST MODE FOR CARRYING OUT THE INVENTION

Figure 1:
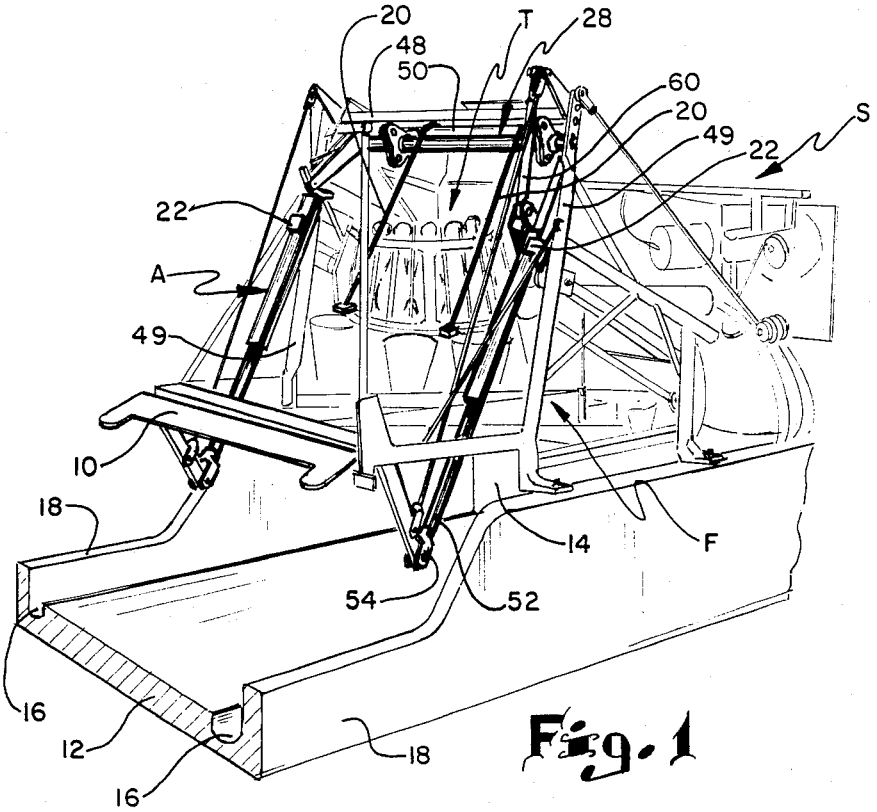
FIG. 1 is a perspective view of an automatic pin setting apparatus which includes a modular rake shaft assembly of this invention.
Figure 2:
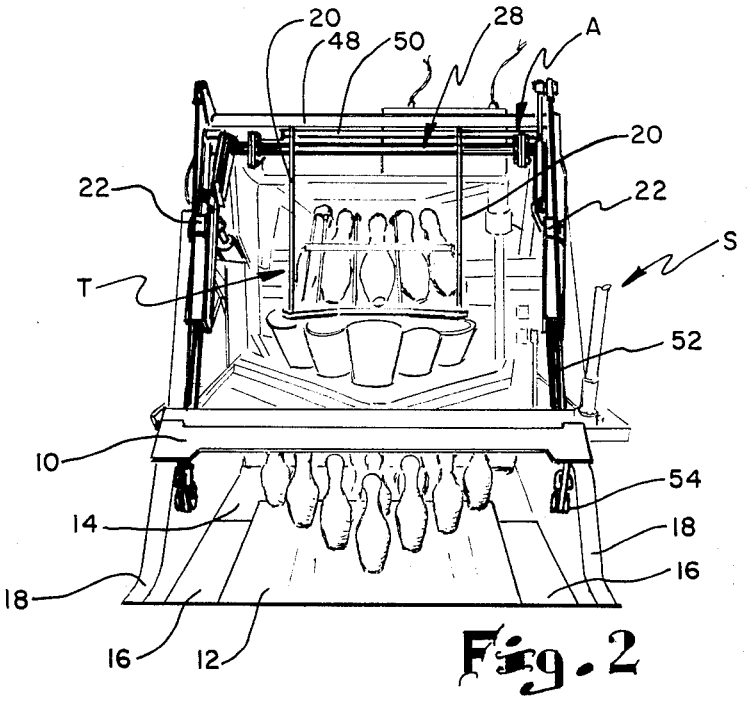
FIG. 2 is a front elevational view of the apparatus of FIG. 1.

In accordance with this invention, a modular rake shaft assembly A is provided on a bowling pin setting apparatus S for moving rake board 10 from the raised position shown in FIG. 1 along an arcuate pass so as to sweep any pins on alley 12 into the pit 14 at the end of the alley. Conveniently, there are gutters 16 on each side of the alley bounded by side boards 18 to which a support frame assembly F is mounted, as shown. A turret assembly T is suspended above the alley, as by a pair of support rods 20 which extend forwardly over the rake shaft assembly A, as shown in FIGS. 1 and 2. The turret assembly is used to collect the pins and position them for lowering them onto the alley after the completion of each frame of bowling.

The modular rake shaft assembly A of this invention is intended to replace the original equipment rake shaft assembly which is a single unitary generally U-shaped assembly having a transverse pivot rod with two depending arms for connection to the rake board 10. The difficulty encountered with the original equipment rake shaft assembly is that through repeated use wherein the arms strike stops 22 during each cycle, the depending arms ultimately fatigue and break at this point. Repairs are usually undertaken wherein the arms are welded but the result is that they ultimately break again at a lower point. They can be rewelded but the breaking continues to occur, always toward the distal end. Ultimately, the assembly must be replaced and since it is made in one piece, substantial disassembly of the pin setting apparatus S must be undertaken. In particular, supports 20 must be removed and turret T dropped down. In addition, the frame F must be at least partially disassembled in order to get the broken sweep arm assembly out. This is extremely time consuming, resulting in extensive down time of the bowling alley and very high labor costs in replacing the rake shaft assembly. Furthermore, since the assembly is rather large and bulky, it is expensive to ship.

Figure 3:
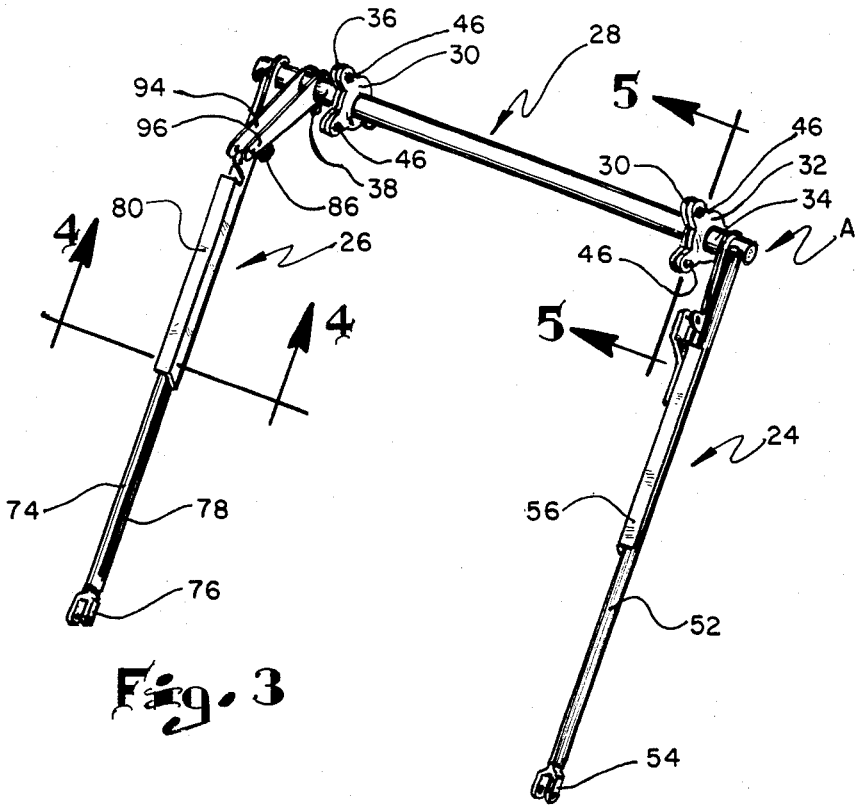
FIG. 3 is a perspective view of the modular rake shaft assembly of this invention.
Figure 4:
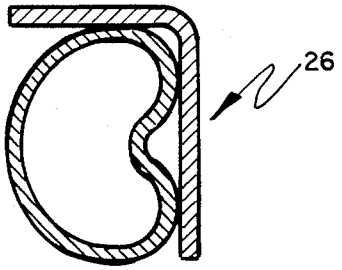
FIG. 4 is a greatly enlarged, transverse section, taken along line 4—4 of FIG. 3, showing details of the sweep arm construction.

As best seen in FIG. 3, the modular rake shaft assembly A of this invention comprises three components, namely a right rake sweep arm 24 and a left rake sweep arm 26 interconnected at their upper ends by a tubular member 28. As can best be seen in FIG. 3, each end of tubular member 28 terminates in a flange 30. One flange 30 is connected to a flange 32 on stub shaft 34 of sweep arm 24 whereas the other flange 30 is connected to a flange 36 on stub shaft 38 of sweep arm 26.

Figure 5:
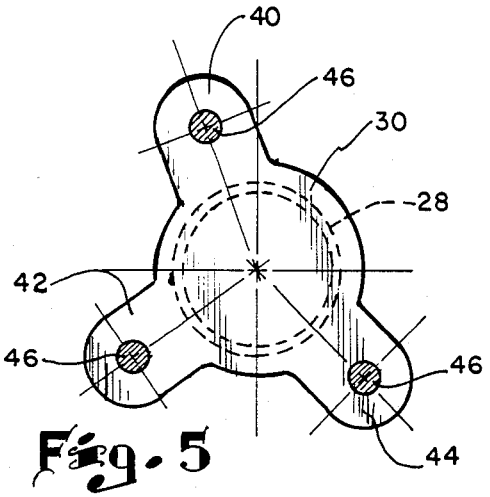
FIG. 5 is an enlarged section, taken along line 5—5 of FIG. 3, showing the spacing of the lobes on one of the flanges of the modular rake shaft assembly.

A detail of flange 30 is shown in FIG. 5 and all of the other flanges have the identical configuration. Conveniently, flange 30 has three lobes 40, 42, and 44, each having a central opening through which bolts 46 pass to interconnect the flanges. Conveniently, lobes 40 and 44 are at an angle of approximately 150 to each other and at an angle of 105 respectively with respect to center lobe 42. This greater spacing between lobes 40 and 44 allows the rake arm assembly to pivot without the flanges striking a cross bar 48 of frame F, as well as rod 50 to which the upper ends of support rods 20 are attached, as best seen in FIGS. 1 and 2. Center lobe 42 extends between parallel arms 24 and 26 but at an angle to a plane formed by the arms.

Right sweep arm 24 in addition to flange 32 and stub shaft 34 includes an arm member 52 which depends from stub shaft 34 and has a yoke 54 at the distal end thereof. An angle member 56 is attached to arm member 52, as by welding, and extends along a substantial length of arm member 52, as shown. Conveniently, the forward surface of angle 56 strikes stop 22 near the upper end of the angle member at the end of each swinging cycle of the rake arm. Because of the strengthening provided by the angle member, the likelihood of arm member 52 being broken or bent is minimized.

Figures 6, 7:
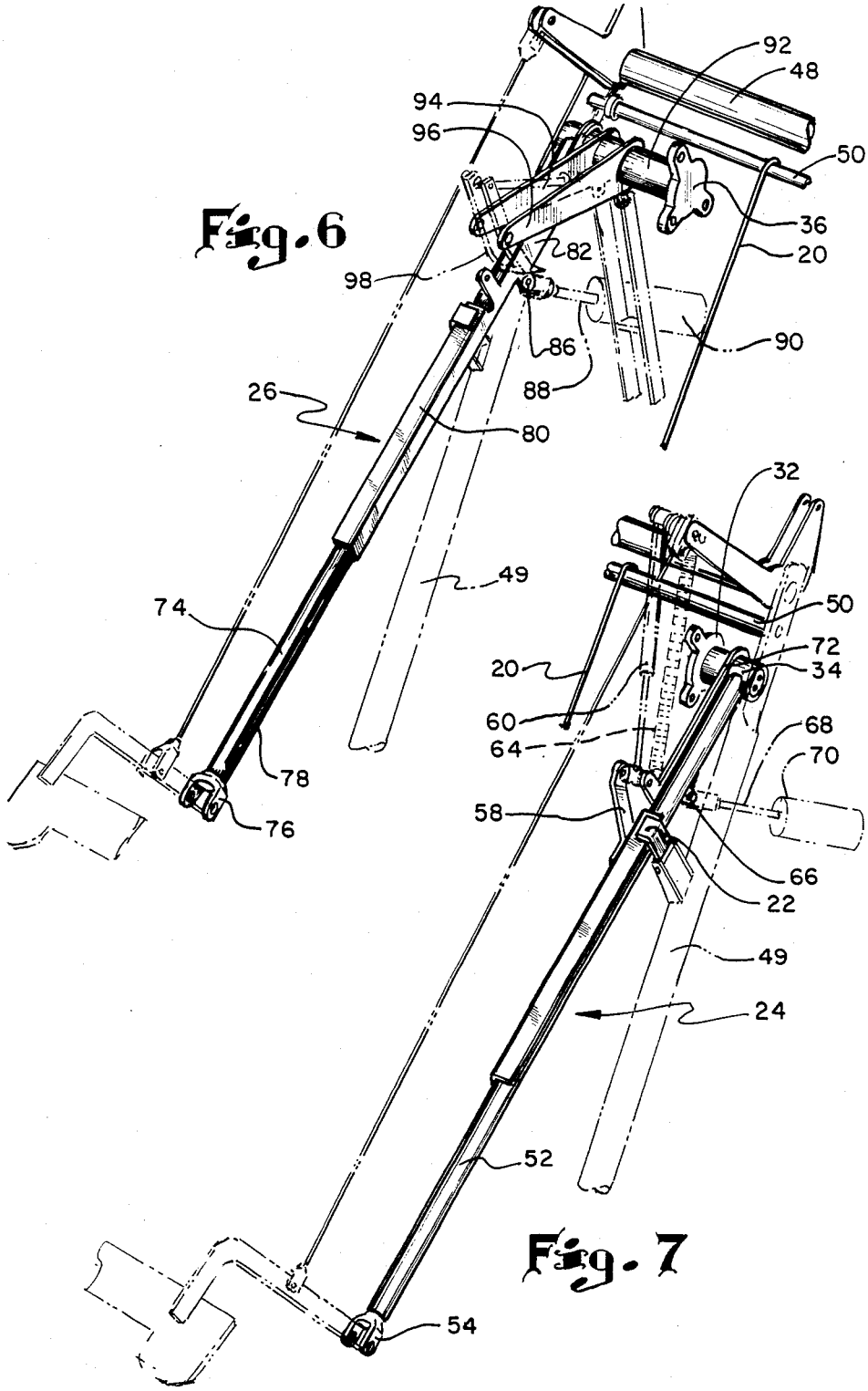
FIG. 6 is an enlarged, perspective view of the left sweep arm of the modular rake shaft assembly showing how it is connected to the pin setting apparatus.
FIG. 7 is an enlarged, perspective view of the right sweep arm of the modular rake shaft assembly showing how it is connected to the pin setting apparatus.

An offset flange 58 is connected, as by welding, to the inner upper portion of angle member 56 for connection to a portion of the activating mechanism for the rake arms, such as piston 60 shown in FIG. 7. A second flange 62 is connected to the side of arm member 52 above angle member 56 and is laterally spaced from the upper end of orrset flange 58. This flange, conveniently, serves as a point of connection for a spring 64 which is also part of the activation mechanism for the sweep arms. A third flange 66 is provided at the bottom and generally opposite flange 62 for attachment to a piston rod 68 of activation piston 70, as shown. Advantageously, both flanges 62 and 66 can be provided on opposite sides of a plate 72 attached to the inner side of arm member 52 at the upper end thereof. A portion of this plate can extend around stub shaft 34, as seen in FIG. 7.

The left rake sweep arm 26 is substantially the same as right rake sweep arm 24. It includes an arm member 74 having a yoke 76 connected at the distal end and including a longitudinal groove 78 extending substantially the full length of the inner side of arm 74, as best seen in FIG. 6. The arm is further strengthened by angle member 80 whose upper end is positioned to strike against stop 22 during the cycling of the apparatus. A plate 82 extends upwardly as an integral part of angle member 80 and includes an upper flange 84 for connection to a suitable spring (not shown) and a lower flange 86 which connects to piston arm 88 of piston 90. It will be understood that pistons 90 and 70 work in concert to swing the modular rake shaft assembly duing each cycling of the pin setting apparatus S. At the upper end of arm 74 is a stub shaft 92 which is substantially longer than stub shaft 34 and includes a pair of spaced flanges 94 and 96 which are connected to a latch mechanism 98 which forms a part of the activation mechanism for the pin setting apparatus.

The way in which the modular rake arm assembly is pivotably mounted on the frame assembly can best be seen by viewing FIG. 9. The upper end of frame arm 49 has a flattened upper end portion 100 and a cylindrical pivot block 102 is connected to the inside thereof, as by bolts 104. Conveniently, block 102 has a bearing sleeve 106 thereon about which the open end of stub shaft 32 pivots. A similar arrangement is provided at the upper end of the other side of the arm so that stub shaft 92 can pivot thereon.

From the foregoing, the advantages of this invention are readily apparent. A modular rake shaft assembly has been devised which can be assembled and disassembled without disassembly of the frame of the automatic bowling pin setting apparatus. Furthermore, the sweep arms of the modular unit each have grooved sides to deform the tubular shape thereof to increase the strength of the arms against bending and are further provided with longitudinally extending angles, the upper end of which serves as an abuttment against a stop on the frame and further strengthen the arms against bending or breaking. Conveniently, the upper end of each arm is provided with a stub shaft having a hollow end serving as a bearing for pivoting the arms about a pivot block attached to the frame. Additionally, the stub shafts are provided with suitable flanges for connection to the operative mechanism of the pin setting apparatus to swing the sweep arms during each cycle of the pin setting machine. Finally, the connection between the modular units are flanges having three spaced lobes through which fastening means, such as bolts, extend to connect the flanges. The lobes are spaced around the periphery of the flanges so that the end lobes are spaced on the order of 105 degrees from the center load but on the order of 150 degrees from each other to accommodate the structural elements of the frame when the sweep arm assembly swings.

The invention has been described in detail with particular reference to a preferred embodiment thereof, but it will be understood that variations and modifications can be effected within the spirit and scope of this invention.

We claim:

1. A modular rake shaft assembly for an automatic bowling pin setting machine, said modular assembly comprising:

a pair of spaced parallel elongated rake arms, each arm being tubular and having a first end and a second end, a yoke connected to said first end of each arm for pivotal attachment to a rake board and a pivot means mounted on said second end of each arm along an axis transverse to said arms;

a removable shaft extending between said pivot means;

a flange plate at each end of said shaft;

a flange plate mounted on each of said pivot means and corresponding in shape and size to said flange plates on said shaft; and fastening means connecting said respective flange plates.

2. An assembly, as claimed in claim 1, wherein:

said flange plates each have three lobes spaced around said flange plate with apertures therethrough; and said fastening means includes bolts extending through said apertures to connect said flanges together.

3. An assembly, as claimed in claim 2, wherein:

there are three lobes on each flange wherein two end lobes are respectively spaced approximately 105 from a center lobe which extends between said arms at an angle to a plane formed by said arms.

4. An assembly, as claimed in claim 1, wherein:

a score is provided along a substantial portion of the length of each said arm to deform it to add rigidity to resist bending.

5. An assembly, as claimed in claim 4, further including:

a reinforcement member extending along a portion of each arm to add strength thereto to resist bending.

6. An assembly, as claimed in claim 5, wherein said reinforcement member includes;

an angle member attached to each of said arms.

7. An assembly, as claimed in claim 1, further including;

a lever arm connected to said pivot means of one of said arms for connection to power means for swinging said arms about the axis of said shaft.

8. A modular rake shaft assembly for an automatic bowling pin setting machine, said modular assembly comprising:

a pair of parallel, spaced elongated arms, each arm including:

a tubular member having a generally circular cross-section;

a score along one side of said tubular member to deform said one side to increase the strength of said member against bending;

a U-shaped bracket at a first distal end of said arm for attachment to a rake;

a stub shaft, having an inner end and an outer end, connected to and extending transversely across a second end of said arm and having a bearing means formed in said outer end for pivoting said arm about a transverse axis;

an inwardly facing flange attached to said inner end of each of said stub shafts;

a pivot shaft extending between said arms having a first and second end each having a flange corresponding in size and shape to said inwardly facing flanges; and means removably connecting said respective stub shaft flanges to said respective pivot shaft flanges to facilitate assembly and disassembly of said rake shaft assembly.

9. An assembly, as claimed in claim 8, further including:

a reinforcement member extending along a portion of each arm to add strength thereto to resist bending.

10. An assembly, as claimed in claim 9, wherein said reinforcement member includes;

an angle member attached to each of said arms.

11. An assembly, as claimed in claim 10, wherein:

one side of each said angle member extends as a plate which extends around said respective stub shafts and is perpendicular thereto.

12. An assembly, as claimed in claim 11, wherein:

each said plate has a pair of flanges, each of said flanges extending in opposite directions from the edges of said plate for attachment to actuation means on the pin setting machine.

13. An assembly, as claimed in claim 12, further including:

an offset attached to said angle member on said arm attached to said shorter stub shaft for connection to actuation means on the pin setting machine.

14. An assembly, as claimed in claim 8, wherein:

one of said stub shafts is longer than the other.

15. An assembly, as claimed in claim 14, wherein:

said longer stub shaft has two spaced, parallel flanges extending forwardly and downwardly with respect to said arms for connection to a latch mechanism for pivoting said assembly.

* * * * *